US005502874A

United States Patent [19]

Lucas

[11] Patent Number: 5,502,874

[45] Date of Patent: Apr. 2, 1996

[54] SPEED REGULATING VALVE FOR FLUID FILLED DOOR CLOSERS

[75] Inventor: Craig L. Lucas, Princeton, Ill.

[73] Assignee: Schlage Lock Company, San Francisco, Calif.

[21] Appl. No.: 289,478

[22] Filed: Aug. 11, 1994

[51] Int. Cl.[6] ..... E05F 3/04; E05F 3/10

[52] U.S. Cl. ..... 16/62; 16/52; 16/DIG. 9

[58] Field of Search ..... 251/31, 58, 66, 251/73, 294; 91/471; 92/24, 134, 130 A, 137; 16/52, 62, 66, DIG. 9, DIG. 21, DIG. 39

[56] References Cited

U.S. PATENT DOCUMENTS

| | | | |
|---|---|---|---|
| 3,852,846 | 12/1974 | Slaybaugh | 16/62 |
| 4,234,996 | 11/1980 | Jentsch | 16/52 |
| 4,256,293 | 3/1981 | Burgess | 16/52 |
| 4,267,619 | 5/1981 | Suska | 16/52 |
| 4,285,094 | 8/1981 | Levings, Jr. | 16/66 |
| 4,386,446 | 7/1983 | Zunkel et al. | 16/58 |

*Primary Examiner*—W. Donald Bray
*Attorney, Agent, or Firm*—Robert F. Palermo

[57] ABSTRACT

A valve for regulating speed of operation of a door closer, includes an elongated hollow tubular body having a closed first end with driving provisions thereon, an open second end, and an orifice in its sidewall adjacent its closed first end; an endplug for a cylinder bore of the door closer, the endplug having an axial port in which the closed first end of the tubular body is rotatably supported and which provides a fluid tight seal about the outer surface of the tubular body; an annular valve seat adjacent the endplug, the seat being fixed against rotation, and having an open portion and a closed portion which provide varying degrees of occlusion of the orifice when the tubular body is rotated; and a seal plate check valve captured against a piston head and occluding an opening therein during closing, the plate also providing a seal about the outer surface of the tubular body near the open second end thereof.

20 Claims, 3 Drawing Sheets

SPEED REGULATING VALVE FOR FLUID FILLED DOOR CLOSERS

BACKGROUND OF THE INVENTION

This invention relates generally to hydraulic door closers and more particularly to valves for regulating speed of opening and closing of a door having such a closer.

Door closers typically consist of a housing with a fluid filled cylindrical bore in which a spring biases a rack-bearing piston in one direction. A pinion is meshed with the rack so that, when the pinion turns, it drives the piston against the spring to compress it. The pinion shaft projects out of the housing and carries a door closer arm which swings when the pinion turns.

Movement of the piston within the cylindrical bore requires transfer of fluid from one side of the piston to the other. This transfer is effected through fluid passages in the walls of the housing. Generally, the passages are equipped with needle valves or other threaded flow control devices which increase or decrease their projection into the passages according to how much they are turned and in which direction. By this means, fluid flow can be adjusted between wide open and fully closed.

For greater detail of the structure and operation of typical door closers see U.S. Pat. No. 4,386,446 to Zunkel, et al, the specification of which is incorporated herein by reference. When the door is opened, the closer arm turns the pinion which drives the rack and piston against the spring, thereby compressing it. Upon release of the door, the spring drives the piston to turn the pinion, swing the door closer arm, and thereby close the door. Of course, the motion damping action caused by the fluid transfer around the piston works in both directions.

In door closers incorporating regulating valves of the current art the fluid passages are primarily in the housing walls. This requires a great deal of precision drilling and cross drilling as well as threading and fitting. Because of the precision operations required to make closers of that design, there is a higher than normal probability of error. This leads to high rework and scrap losses as well as susceptibility to loss of adjustment.

The foregoing illustrates limitations known to exist in present door closer speed regulating valves. It would, thus, be advantageous to provide an alternative directed to overcoming one or more of those limitations. Accordingly, a suitable alternative is provided including features more fully disclosed hereinafter.

SUMMARY OF THE INVENTION

In one aspect of the present invention, this is accomplished by providing a valve for regulating speed of operation of a door closer, including an elongated hollow tubular body having a closed first end with driving provisions thereon, an open second end, and an orifice in its sidewall adjacent its closed first end; an endplug for a cylinder bore of the door closer, the endplug having an axial port in which the closed first end of the tubular body is rotatably supported and which provides a fluid tight seal about the outer surface of the tubular body; an annular valve seat adjacent the endplug, the seat being fixed against rotation, and having an open portion and a closed portion which provide varying degrees of occlusion of the orifice when the tubular body is rotated; and a seal plate captured against a piston head and occluding an opening therein during closing, the plate also providing a sliding seal about the outer surface of the tubular body near the open second end thereof.

The foregoing and other aspects will become apparent from the following detailed description of the invention when considered in conjunction with the accompanying drawings.

DETAILED DESCRIPTION

Figure 1:
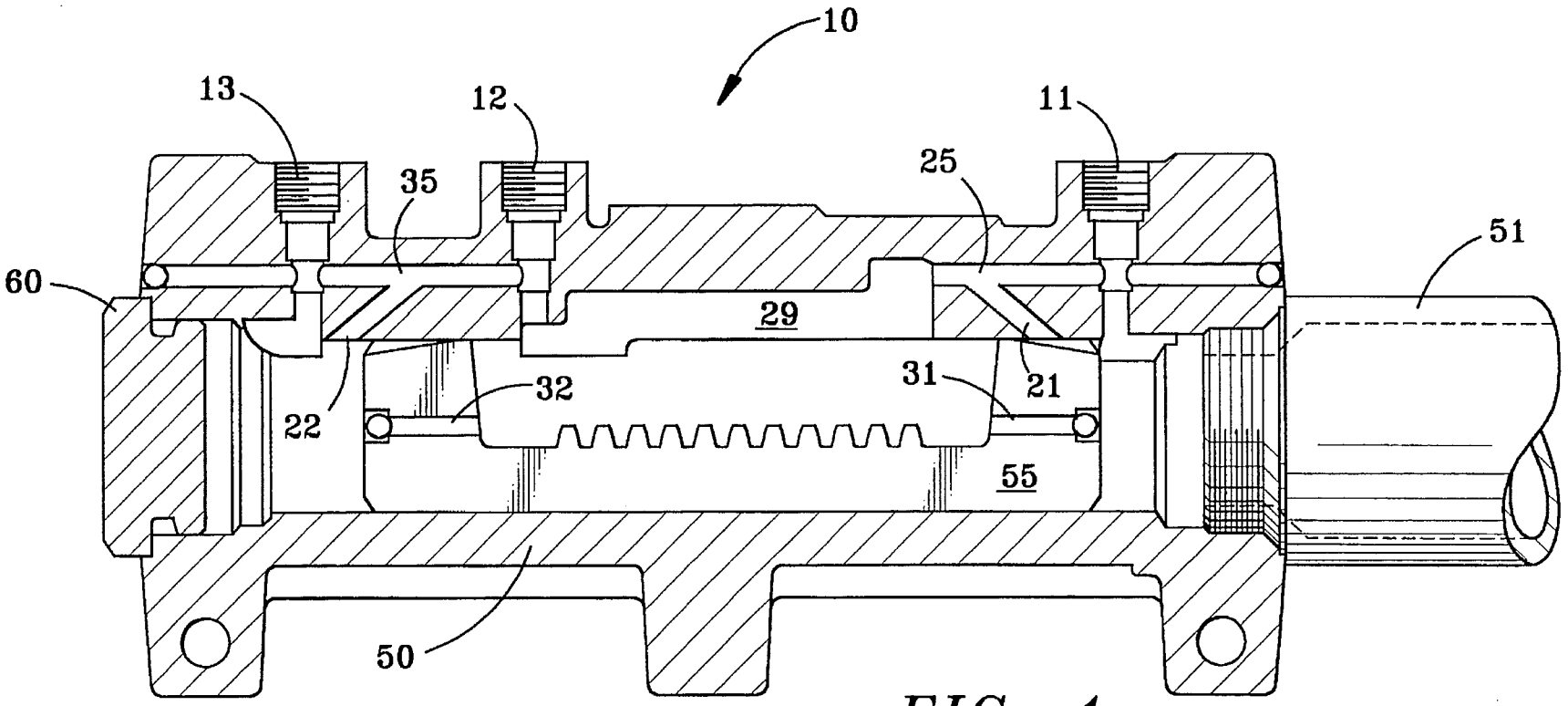
FIG. 1 (PRIOR ART)
FIG. 1 is a schematic cross-sectional fragmentary view illustrating a door closer of the prior art and the fluid passages required for its operation.

FIG. 1 shows the fluid passages typically found in a door closer of the prior art. The housing 50 has a cavity 29 in its wall which connects with longitudinal passage 25 which in turn connects with passage 21 and then with backcheck valve 11. Check valves 31 and 32 supplement flow passage capacity during general door closing and opening, respectively to assist in fluid transfer around piston 55. Longitudinal passage 35 connects between closing valve 12, flow passage 22, and latching valve 13 and cavity 29, depending on the position of piston 55. This arrangement provides opening speed control, opening backcheck just before the door reaches its maximum open position, closing speed control, and latch speed control. The spring which powers closing of the door is not shown, but it extends from the right side of piston 55 into spring housing 51.

Figure 2:
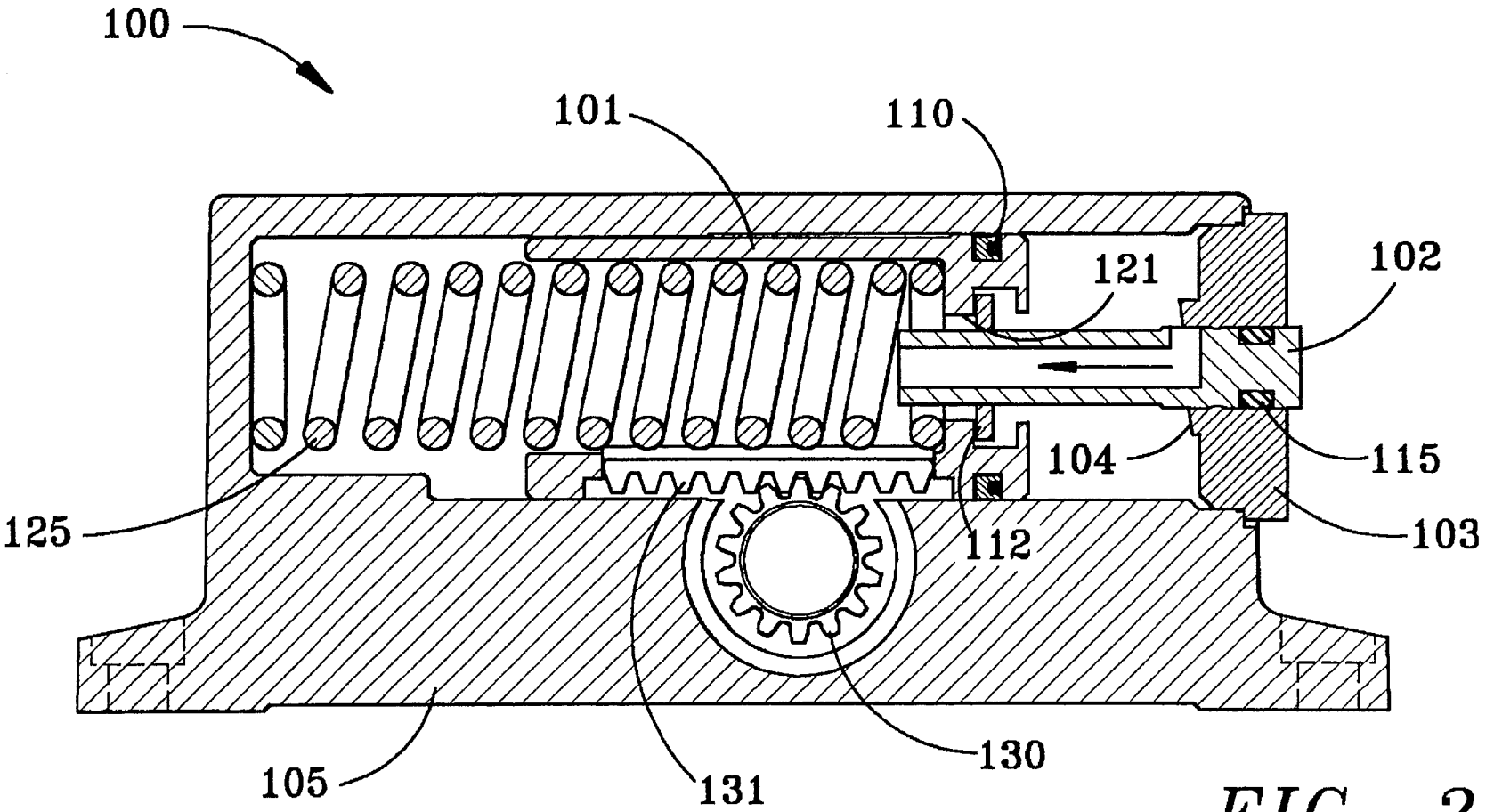
FIG. 2 is a schematic sectional view of a door closer which incorporates an embodiment of the regulating valve of the present invention.

The door closer 100 in FIG. 2 incorporates one embodiment of the regulating valve of the present invention. Except for the valve, the door closer is fairly standard in that it has a cylinder bore in which a spring 125 biases a piston 101 to provide closing force to the door on which the closer is mounted. Rack 131 on piston 101 either drives pinion 130 or is driven by it, depending upon whether the door is being closed or opened. As in all such closers, the fluid (or hydraulic) damping of the door movement is a result of fluid transfer around the piston 101 as it slides in the cylinder.

Figure 3:
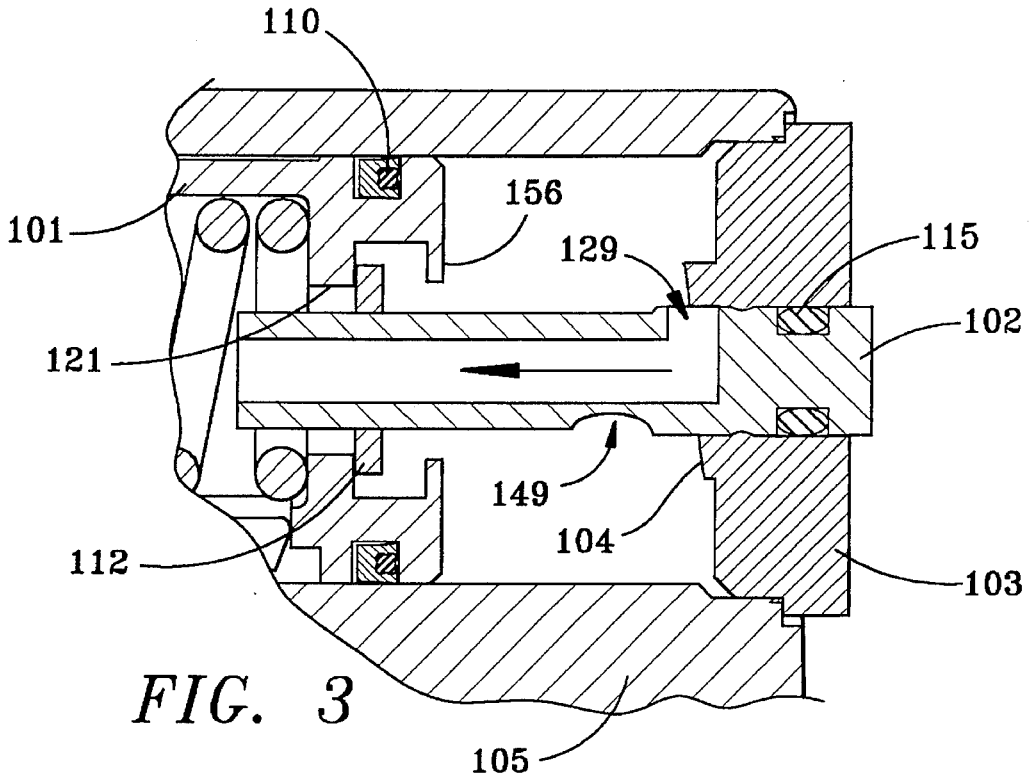
FIG. 3 is a fragmentary sectional view illustrating greater detail of the valve/seat and the valve/seal-plate/piston combinations.

In this embodiment, fluid transfer around the piston 101 is accomplished through the head of the piston which has an opening 121 which has a seal plate 112 to act as a check valve and to seal between piston 101 and the tubular body of valve 102 at opening 121 when the door is closing. Details of this structure are best shown in FIG. 3. Seal plate 112 is held captive against piston opening 121 by lip 156 of piston 101. This causes seal 112 to slide along valve 102 when the piston moves in the cylinder and forces all fluid transfer during closing to take place through valve 102. Regulation of closing speed is accomplished by control of openness of the fluid passage through valve 102. Orifice 129 penetrates the sidewall of the tubular body of the valve at the closed end thereof and thereby permits high pressure fluid being pushed by the piston 101 to pass through the valve 102 and from thence, around the piston to the low pressure side thereof. Seal 110 around the lip of piston 101 seals between the cylinder wall and the piston. Adjacent endplug 103 is annular valve seat 104 which is fixed in place against rotation and which surrounds valve 102 at orifice 129. Valve seat 104 may be integrally formed with endplug 103, or it may be a separate piece fixed against the endplug. Because of the slanted axial face of seat 104, as valve 102 is turned, orifice 129 is covered or occluded by an increasing or decreasing amount varying between fully closed and fully open. When fully open, the damping effect of valve 102 is at its lowest value, while when fully closed, the damping effect is strong enough to prevent movement of the piston 101. To assure that the door does not stick in the open position, a minute bleed hole (not shown) is provided to slowly release the door if the valve 102 is fully closed. The operation so far described is for general closing speed regulation. Of course, it also describes a much weaker general damping of opening speed. For control of latching speed, which occurs during about the last 10 to 15 degrees of closing, one or more longitudinal grooves 149 are provided in the tubular body of valve 102 near the closed end thereof, in the vicinity of orifice 129. This permits blow-by of high pressure fluid between seal plate 112 and valve 102 and provides the higher latching speed required.

A seal 115 in endplug 103 prevents leakage of fluid around valve 102, while the valve is held in place by a snap fit between congruent grooves and ridges around the outer surface of valve 102 and the inner surface of endplug 103. Provisions for rotatably driving valve 102 (not shown) are on the closed end of the valve and may be any non-round form of projection or recess including a slot, a triangular, square, hexagonal, or other form of socket, projecting wings, square, hexagonal, or other forms of projecting drive heads, for example.

Figure 4:
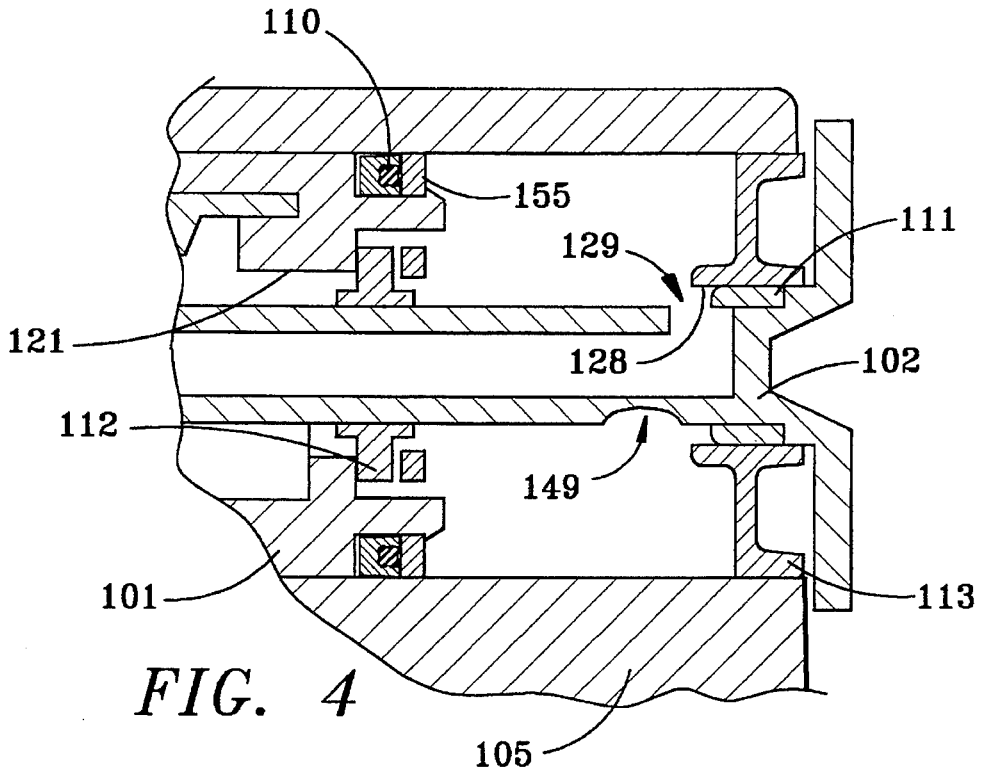
FIG. 4 is a fragmentary schematic illustration of another embodiment of the valve seat together with the valve.

The embodiment shown in FIG. 4 is very similar to that described with respect to FIGS. 2 and 3, and therefore, the same numbers will be used as in those FIGS. when describing the same components. Piston 101 has an opening 121 in its head, against which check valve seal plate 112 is clamped by clamp ring 155 which snaps over a plurality of projecting barbs. Within said seal plate a sliding seal against said tubular valve permits piston 101 to slide along the tubular body during closing without leaking any fluid.

Regulation of operating speed of the closer is achieved by rotating valve 102 in end-seal seat 111, which is fixed against rotation by longitudinal knurling or other non-cylindrical interlocking means with port 128 of endplug 113. End seal seat 111 has a non uniform axial extent and, therefore, when valve 102 is rotated, orifice 129 is closed or opened to greater or lesser degrees to restrict or facilitate fluid flow therethrough and thereby to increase or reduce the hydraulic damping effect of the regulating valve 102. The rotary driving provision is shown as a head having a large width which may have peripheral knurling or other grip enhancement features. This embodiment of valve 102 is also held in place in endplug 113 by congruent rings and grooves, while endseal seat 111 performs double duty as both a fluid seal between valve 102 and port 128 and as the seat which opens or closes orifice 129. Here also, latching speed is provided by one or more longitudinal grooves, in the outer surface of valve 102 in the vicinity of orifice 129, to permit blow-by of fluid between seal and the valve body for faster closing.

The regulating valve embodiments described herein are conveniently depicted as being along the central axis of the piston and cylinder bore. This simplifies illustration and assembly of the closer; because there is no need to be concerned about clock alignment of the components. It is considered that, under some circumstances, it may be more advantageous to make the closer asymmetric and for the fluid flow around the piston to be routed through the walls of the cylinder. By proper choice of materials for the various components, manufacture and assembly, as well as service performance, can be significantly improved.

What is claimed is:

1. A valve for regulating speed of operation of a door closer, comprising:

an elongated hollow tubular body having a closed first end with means thereon for rotatably driving said body, an open second end, and an orifice in its sidewall adjacent its closed first end;

an endplug for a cylinder bore of said door closer, the endplug having an axial port in which the closed first end of the tubular body is rotatably supported and which includes means for forming a fluid tight seal about the outer surface of the tubular body;

an annular valve seat adjacent the endplug, said seat being fixed against rotation, and having a non-constant axial extent which provides varying degrees of occlusion of the orifice when the tubular body is rotated; and a seal plate check valve captured against a piston head and sealing an opening therein during closing, said plate also providing a seal about the outer surface of said tubular body near said open second end thereof.

2. The valve of claim 1, wherein the means for rotatably driving on said closed first end of said tubular body comprises a non-circular recess having at least one flat side.

3. The valve of claim 1, wherein the means for rotatably driving on said closed first end of said tubular body comprises a non-circular projection having at least one flat side.

4. The valve of claim 1, wherein the annular valve seat adjacent the endplug is formed with the endplug as a single piece.

5. The valve of claim 1, wherein the annular valve seat adjacent the endplug is formed from a polymeric material.

6. The valve of claim 1, wherein the annular valve seat and the tubular body are formed from a polymeric material.

7. The valve of claim 1, wherein the annular valve seat and the tubular body are formed from metal.

8. The valve of claim 1, further comprising:

means, near the first closed end of said tubular body, for allowing blow-by of fluid between said seal plate and said tubular body.

9. The valve of claim 8, wherein said means for allowing blow-by of fluid between said seal plate and said tubular body comprises at least one longitudinal groove on the outer surface of the tubular body.

10. In a door closer which has a housing with a cylindrical bore, a rack-bearing piston and a spring in the bore, a pinion engaged with the rack such that the pinion turns when the piston slides, and a closer arm connected to the piston to swing when the pinion turns, the improvement in combination with said door closer, comprising:

an elongated hollow tubular body having a closed first end with means thereon for rotatably driving said body, an open second end, and an orifice in its sidewall adjacent its closed first end;

an endplug for a cylinder bore of said door closer, the endplug having an axial port in which the closed first end of the tubular body is rotatably supported and which includes means for forming a fluid tight seal about the outer surface of the tubular body;

an annular valve seat adjacent the endplug, said seat being fixed against rotation, and having an open portion and a closed portion which provide varying degrees of occlusion of the orifice when the tubular body is rotated; and a seal plate check valve captured against a piston head and sealing an opening therein during closing, said plate also providing a seal about the outer surface of said tubular body near said open second end thereof.

11. The combination of claim 10, wherein the means for rotatably driving on said closed first end of said tubular body comprises a non-circular recess having at least one flat side.

12. The combination of claim 10, wherein the means for rotatably driving on said closed first end of said tubular body comprises a non-circular projection having at least one flat side.

13. The combination of claim 10, wherein the annular valve seat adjacent the endplug is formed with the endplug as a single piece.

14. The combination of claim 10, wherein the annular valve seat adjacent the endplug is formed from a polymeric material.

15. The combination of claim 10, wherein the annular valve seat and the tubular body are formed from a polymeric material.

16. The combination of claim 10, wherein the annular valve seat and the tubular body are formed from metal.

17. The combination of claim 10, further comprising:

means, near the first closed end of said tubular body, for allowing blow-by of fluid between said seal plate and said tubular body.

18. The combination of claim 17, wherein said means for allowing blow-by of fluid between said seal plate and said tubular body comprises at least one longitudinal groove on the outer surface of the tubular body.

19. A valve for regulating closing speed and latching speed of a door closer, comprising:

an elongated hollow tubular body having a closed first end with means thereon for rotatably driving said body, an open second end, and an orifice in its sidewall adjacent its closed first end;

an endplug for a cylinder bore of said door closer, the endplug having an axial port in which the closed first end of the tubular body is rotatably supported and which includes means for forming a fluid tight seal about the outer surface of the tubular body;

an annular valve seat adjacent the endplug, said seat being fixed against rotation, and having a non-constant axial extent which provides varying degrees of occlusion of the orifice when the tubular body is rotated;

a seal plate check valve captured against a piston head and sealing an opening therein during closing, said plate also providing a seal about the outer surface of said tubular body near said open second end thereof; and means for increasing speed of said door closer to provide latching force.

20. The valve of claim 19, wherein said means for increasing speed of said door closer to provide latching force comprises at least one longitudinal groove on the outer surface of the tubular body near said first closed end, said groove permitting blow-by of fluid between said seal plate and said tubular body.

* * * * *